US006206788B1

(12) United States Patent
Krenzler

(10) Patent No.: US 6,206,788 B1
(45) Date of Patent: Mar. 27, 2001

(54) ADJUSTABLE LOFT GOLF CLUB

(76) Inventor: Leo M. Krenzler, 28303 Soundview Dr. S. #303, Des Moines, WA (US) 98198

( * ) Notice: Subject to any disclaimer, the term of this patent is extended or adjusted under 35 U.S.C. 154(b) by 0 days.

(21) Appl. No.: 09/510,324

(22) Filed: Feb. 22, 2000

(51) Int. Cl.[7] ..... A63B 53/06; A63B 69/36
(52) U.S. Cl. ..... 473/245; 473/247
(58) Field of Search ..... 473/244, 245, 473/246, 247, 248, 238, 219, 288, 324, 350, 305, 307, 314, 336; D21/747, 748

(56) References Cited

U.S. PATENT DOCUMENTS 670,522 * 3/1901 Thompson .
2,777,694 * 1/1957 Winter .
2,882,053 * 4/1959 Lorthiois .
5,133,553 * 7/1992 Divnick .
5,462,279 * 10/1995 Culpepper .

FOREIGN PATENT DOCUMENTS

591595 * 8/1947 (GB) ..... 273/79

* cited by examiner

*Primary Examiner*—Sebastiano Passaniti
(74) *Attorney, Agent, or Firm*—Delbert J. Barnard

(57) ABSTRACT

A golf club head (16) is provided with a rough heel end surface (40) that surrounds a threaded opening (38) that enters into the heel (36) of the club head (16) and extends substantially longitudinally of the club head (16). A thin washer (42) is placed against the rough surface (40) then, a similar rough surface (24) on a hosel eye (20) is moved into contact with the opposite surface of the washer (42). A connector bolt (18) is inserted through an opening (22) in the hosel eye (20) and is threaded into the opening (38) in the club head (16). The club head (16) is rotated relative to the club hosel (14) to place it into a desired loft angle. Then, the bolt (18) is tightened. This draws the rough surfaces (24, 40) into tight contact with the washer (42). The surfaces (24, 40) are harder than the washer material and when the bolt (18) is tightened, points or edges on the surfaces: (24, 40) dig into the washer material. This construction allows substantially an infinite number of loft angle settings of the club head (16) relative to the club shaft (12).

14 Claims, 3 Drawing Sheets

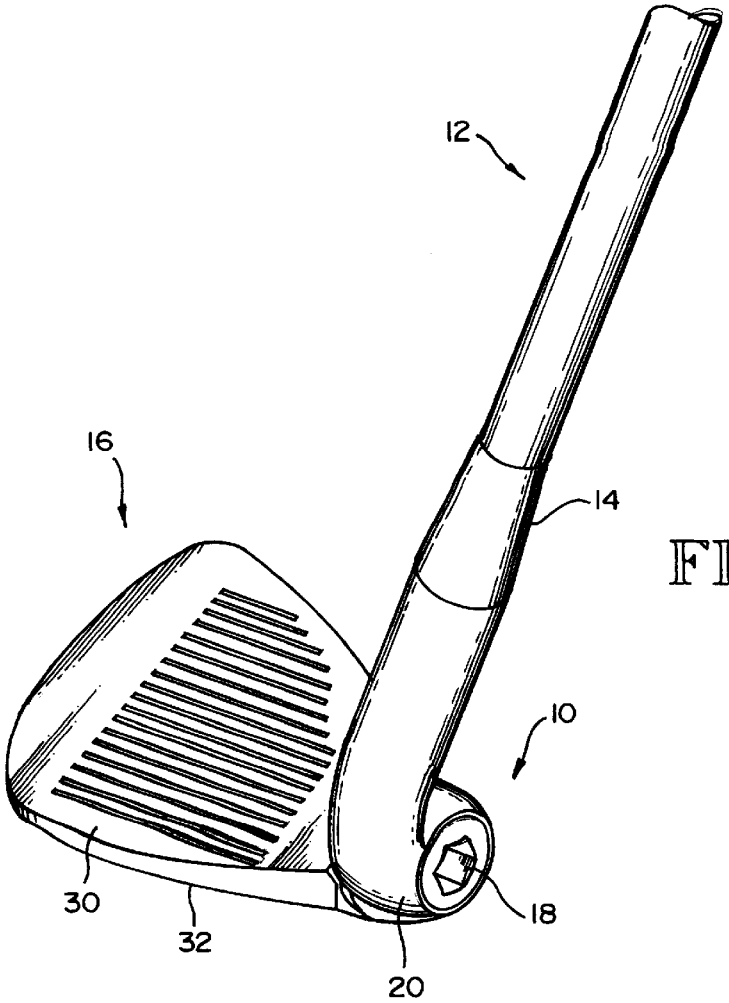
FIG. 1
FIG. 2
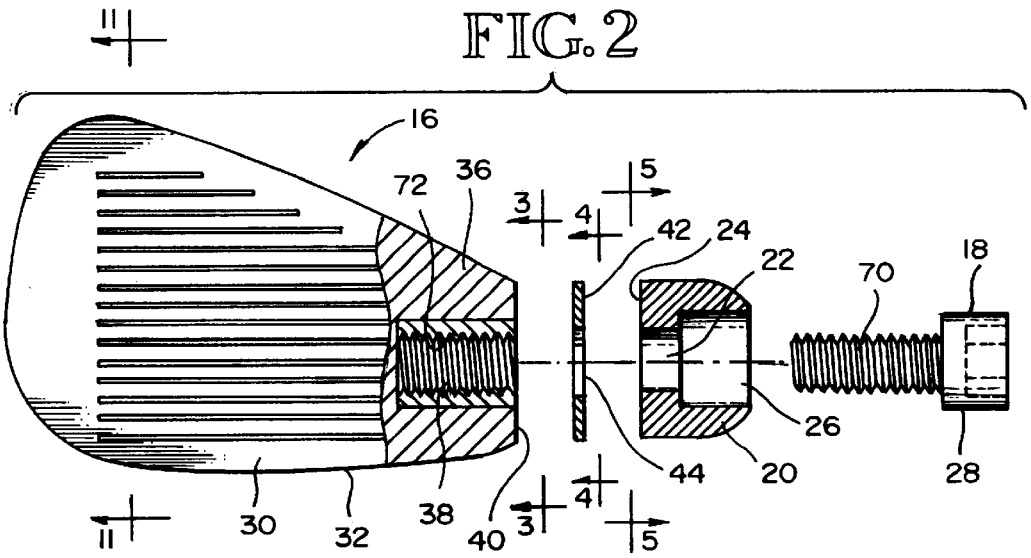

FIG. 3
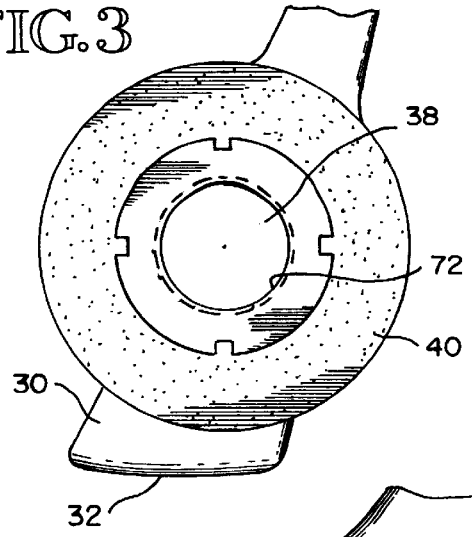
FIG. 4
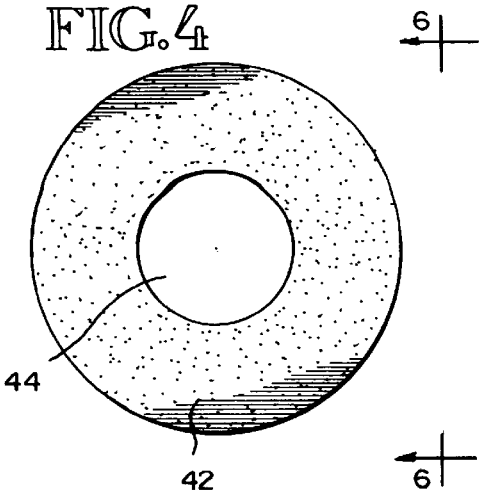
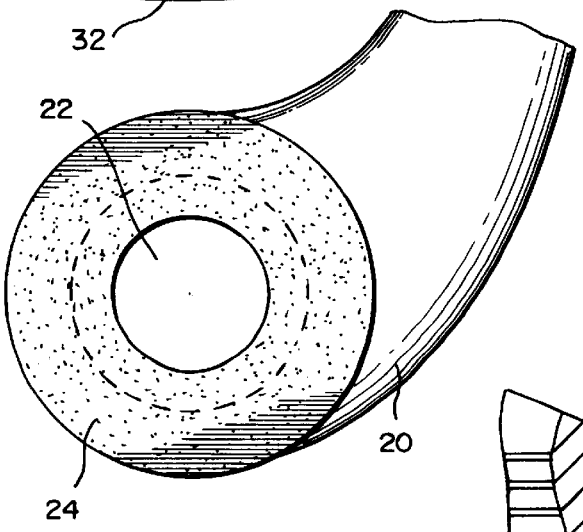
FIG. 5
FIG. 6
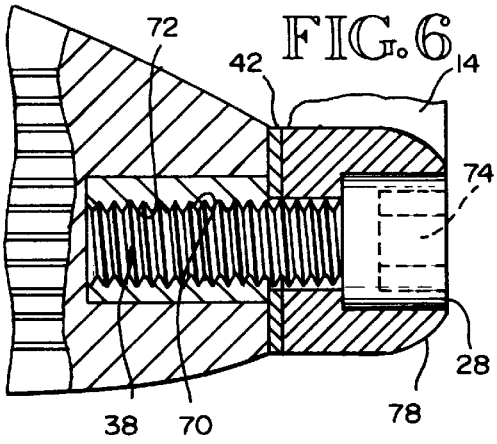
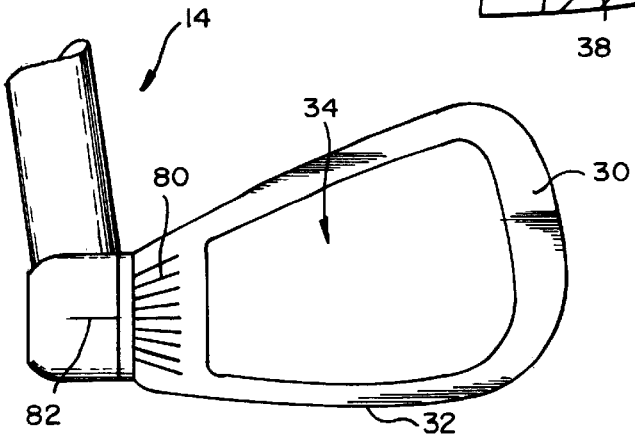
FIG. 7

ADJUSTABLE LOFT GOLF CLUB

TECHNICAL FIELD

This invention relates to the provision of an adjustable loft golf club that is adapted to take the place of a full set of golf clubs.

BACKGROUND OF THE INVENTION

It is known to adjustably connect the head of a golf club to its shaft so that the loft angle of the club can be changed and a single club can be used in place of a set of clubs. These clubs are in the patent literature sometimes referred to as "universal clubs." Examples of known "adjustable loft" or "universal" golf clubs are disclosed by the following United States Patents: U.S. Pat. No. 2,027,452, granted Jan. 14, 1936, to Gunnar Rusing; U.S. Pat. No. 2,091,794, granted Aug. 31, 1937, to Ray Pester; U.S. Pat. No. 2,214,079, granted Sep. 10, 1940, to Clair G. Horton; U.S. Pat. No. 2,962,287, granted Nov. 29, 1960, to R. D. Brouwer; U.S Pat. No. 3,601,399, granted Aug. 24, 1971, to Martyn L. Agens and Robert S. Wallace; U.S. Pat. No. 4,878,666, granted Nov. 7, 1989, to Rokuro Hosoda; U.S. Pat. No. 5,083,779, granted Jan. 28, 1992, to Brett A. Ungermann; U.S. Pat. No. 5,133,553, granted Jul. 28, 1992, to Stevan M. Divnick and U.S. Pat. No. 5,928,087, granted Jul. 27, 1999, to Elaine Simone Emberton, George Thomas Harvey and Thomas Ramsey Watson. An adjustable head golf club is also disclosed by British Patent No. 8864, granted May 10, 1892.

There is a need for an adjustable loft golf club that is adjustable for an infinite number of loft angles between the loft angle of a putter and the loft angle of a driving iron. There is also a need for such a golf club that is capable of being constructed from state-of-the-art materials and constructed to include state-of-the-art shaft and head shapes, and which is strong and durable yet simple in construction.

BRIEF SUMMARY OF THE INVENTION

The golf club of the present invention is basically characterized by a hosel having a lower end eye portion that includes a transverse bolt receiving opening having first and second ends, and an annular, substantially flat, metal, first end surface at the first end of said opening. The golf club head has a heel, an internally threaded bolt receiving opening in the heel extending into said club head substantially lengthwise of the club head, and an annular, substantially flat, metal, heel surface surrounding the bolt receiving opening in said club head. A flat washer is positionable axially between the metal, first end surface on said hosel and the metal, heel surface on the club head. The washer has a center opening and opposite sides. The threaded shank of a bolt extends into and through the bolt receiving opening in the hosel, from the side thereof opposite the club head, then through the center opening in the washer, and then into the bolt receiving opening in the club head. The threaded shank of the bolt is threadable into the bolt receiving opening in the club head. The bolt includes a head opposite the threads that bears against the hosel when tightened. The club head can be rotated about the bolt axis to provide a desired loft angle. Then, the bolt can be tightened to connect the club head to the hosel at the selected loft angle.

According to the invention, the washer is made from a material that is softer than the metal, first end surface on the hosel and is softer than the metal, heel surface on the club head. The metal first end surface on the hosel and the metal, heel surface on the club head are rough surfaces having grains that penetrate into the opposite sides of the washer when the bolt is tightened, for holding the club head against rotation relative to the hosel.

In the preferred embodiment, the washer material is constructed of aluminum or an alloy that is predominately aluminum.

Preferably also, the hosel includes a countersink at the second end of the bolt receiving opening sized to receive the bolt head and the bolt head is in the countersink when it is tightened.

The grains that form the rough surfaces may be, for example, in the form of small points that penetrate into the washer, or in the form of small lines with edges that penetrate into the washer. The points may be formed by sandblasting the surfaces.

Pester U.S. Pat. No. 2,091,794; Agens et al. U.S. Pat. No. 3,601,399; Hosoda U.S. Pat. No. 4,878,666; Ungermann U.S. Pat. No. 5,083,779; Emberton et al. U.S. Pat. No. 5,928,087 and Divnick U.S. Pat. No. 5,133,553 all utilize two sets of mating teeth for establishing the several positions of the club head relative to the club shaft. A problem with the use of teeth or splines is that they limit the possible loft angle settings. The golf club of the present invention provides for an infinite number of loft angle settings without sacrificing the ability of the adjustment mechanism to hold the club head secure in the selected loft angle relative to the shaft of the club.

Pester U.S. Pat. No. 2,091,794 connects the club head to a lower eye portion of a hosel by use of a connector assembly that includes a bolt having a head that is countersunk into a rear portion of the hosel eye. However, this club requires the use of a projection on the heel that includes teeth or serrations on its periphery. It also requires the presence of a lock bolt in the hosel and supporting structure that allows teeth or serrations on the lock bolt to move into and out from engagement with the serrations on the periphery of the projecting heel portion of the club head. The adjustable head club of the present invention provides a bolt connection with a countersunk head that is much simpler than the club disclosed by Pester U.S. Pat. No. 2,091,794 and which permits utilization of a more conventional hosel and club shaft, and the construction of the club from state-of-the-art materials.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

Like reference numerals are used to designate like parts throughout the several views of the drawing, and:

FIG. 1 is a fragmentary pictorial view of a lower end portion of a golf club, looking generally towards the face of the club and the back of the hosel, with the shaft above the hosel in broken away;

FIG. 2 is a front face elevational view of the club head, a lower portion of the hosel, a bolt that extends through the hosel and screws into the club head, and a washer that is positioned between the hosel and the heel of the club head;

FIG. 3 is an end elevational view taken substantially along the aspect of line 3—3 of FIG. 2;

FIG. 4 is an end elevational view taken substantially along the aspect of line 4—4 of FIG. 2;

FIG. 5 is an end elevational view taken substantially from the aspect of line 5—5 of FIG. 2;

FIG. 6 is an enlarged scale fragmentary view showing the bolt installed for connecting the club head to the hosel with the washer between the heel of the club head and the interface of the hosel;

FIG. 7 is a rear view of the club head and a fragmentary portion of the hosel, showing gauge lines that inform the user of certain of the loft angles;

DETAILED DESCRIPTION OF THE INVENTION

Figure 8:
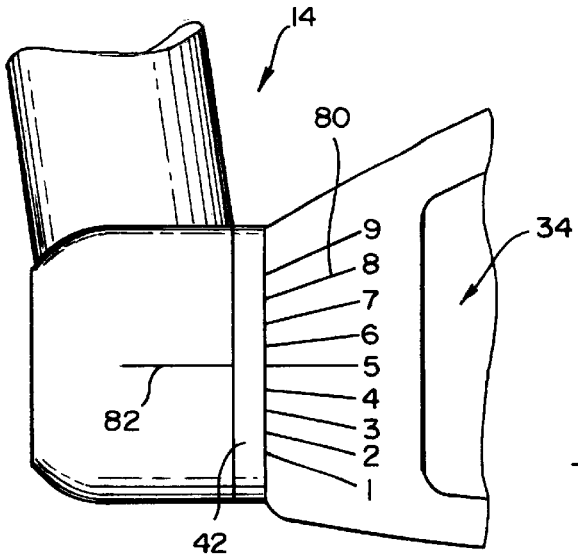
FIG. 8 is an enlarged scale view of the gauge portion of FIG. 7.

FIG. 1 shows a lower end portion of a golf club 10. Specifically, it shows a lower portion of the club shaft 12, including a full showing of a hosel 14, and a club head 16 that is adjustably connected to the hosel 14 by a bolt 18. Referring to FIGS. 2–8, the hosel 14 includes a lower end eye 20 having a transverse bolt receiving opening 22. The hosel eye 20 includes an annular end surface 24 at the inner end of the opening 22. The second end of opening 22 is provided with a countersink 26 that is sized and shaped to receive bolt head 28 on bolt 18.

Club head 16 includes front face 30, a lower edge 32, a back side 34 and a heel 36. Heel 36 includes an internally threaded heel opening 38 that extends substantially lengthwise of the club head 16. Heel 36 further includes an annular heel and surface 40 that confronts the first end surface 24 on the hosel eye 20. A thin washer 42 is positioned to be sandwiched between the surfaces 24, 40. Washer 42 includes a bolt receiving center opening 44. Preferably, when the club head 16 is connected to the hosel eye 20, there is a substantially smooth transition of the peripheral surface on the heel 36 across the peripheral surface of the washer 42 to the peripheral surface of the hosel eye 20. This is shown by FIG. 6.

Preferably, the club head is a state-of-the-art perimeter weighted club head. Examples of perimeter weighted club heads are disclosed by U.S. Pat. No. 5,707,302, granted Jan. 13, 1998, to Joseph A. Leon and Richard F. Zopf, and U.S. Pat. No. 5,716,288, granted Feb. 10, 1999 to Thomas Salvatore Sasso. A perimeter weighted club is characterized by a thick heel region that mergers with thick upper and lower perimeter regions and a thick toe region, forming a continuous thick perimeter region that surrounds a cavity that is formed in the backside of the club head. The club head-to-hosel connection of the present invention utilizes the thick heel region of the club head for connecting to the bolt 18. The club head 16 may be made from a material that can be itself threaded to provide the internally threaded bolt receiving opening 38. Or, a hardened insert with an internally threaded opening 38 may be press fit into a socket opening formed in the heel region of the club head 16, as is shown in FIGS. 2, 3 and 6.

The club head-to-club shaft connection of the present invention makes possible the use of a hosel 14 of somewhat conventional shape and a shaft structure above the hosel 14 that is a substantially conventional shape. In preferred form, the shaft portion above the hosel is constructed from a graphite material or steel whereas the hosel is constructed from a metal.

Figure 9:
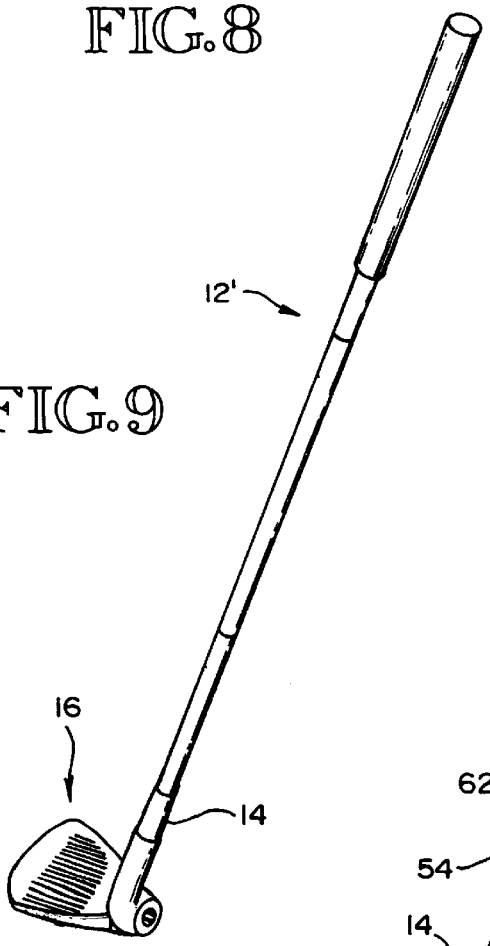
FIG. 9 is a pictorial view of the golf club of FIGS. 1–8 to which the remainder of a shaft has been added.
Figure 10:
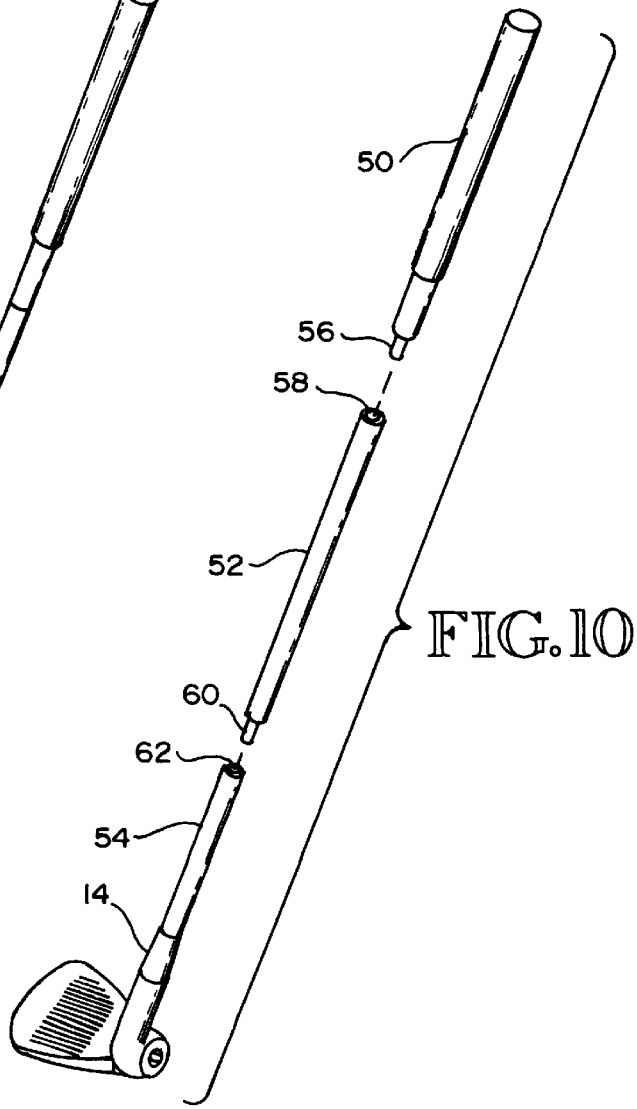
FIG. 10 is a view similar to FIG. 9 but showing a three section shaft with the sections separated and in a spaced relationship.

A common feature of prior art adjustable head golf clubs is to provide a club with an adjustable length handle. Examples of this practice are disclosed by the aforementioned U.S. Pat. Nos. 2,027,452; 2,214,079; 2,091,794; 5,083,779 and 5,133,553. It is an aspect of the present invention to provide the herein disclosed adjustable head golf club with an adjustable length handle the construction of which can vary and includes the constructions disclosed by the above identified patents. Also, it is an aspect of the invention to provide the adjustable head golf club with a sectional handle, such as shown in FIGS. 9 and 10. In this example embodiment, the handle 12 may have three sections: an upper section 50, an intermediate section 52 and a lower section 54. The upper section may include a downwardly projecting, externally threaded shaft 56 that is adapted to screw into a threaded socket 58 formed in the upper end of shaft section 52. Shaft section 52 may have a downwardly directed, externally threaded shaft 60 that is adapted to thread into an internally threaded socket 62 in the lower shaft section 54. The threaded shafts 56, 60 may be made from metal. The internally threaded sockets 58, 60 may be formed in metal inserts that extend into the upper end of the shaft sections 52, 54. The main portions of the shaft sections 50, 52, 54 may be constructed from a known shaft metal or a shaft graphite material. As should be evident, the threaded connections 56, 58 and 60, 62 can be disconnected and the three club sections 50, 52, 54 can be placed side-by-side and can be packaged in this configuration when it is desired to carry or store the club when not playing golf. A relatively small carrying case can be provided which is sized to receive the disconnected sections of the club 50, 52, 54. Also, the club head 16 may be removed from the lower section 54 and be oriented so that its length dimension is parallel with the shaft sections 50, 52, 54 when the club is being stowed.

Referring to FIGS. 2–8, in particular, the heel end surface 40 on the club head 16 and the first end surface 24 on the hosel eye 20 are preferably rough surfaces and they are preferably relatively hard metal surfaces. The washer 42 is preferably made from a softer material, e.g. an aluminum, brass, or copper material or an alloy that is predominately aluminum, brass or copper. The rough surfaces 24, 40 may have randomly or uniformly distributed small points that penetrate into the softer washer material. Or, they may have cuts with edges that penetrate into the softer washer material. By way of typical and therefore non limitive example, the surfaces 24, 40 may be sand blasted to form the points, or be raked, scratched or filed to form the cuts and edges. Any known or yet to be developed manner of making a rough surface with points or edges that will penetrate into the softer washer material can be utilized. The advantage of using rough surfaces of the type described is that the club head can be set into an infinite number of loft angle positions. The number of possible positions is not predetermined by mating serrations or teeth. The club head may be rotated to essentially any position. Then, when the bolt is tightened, the club head is fixed in the selected position. The tightening of the bolt moves the surfaces 24, 40 into tight contact with the washer surfaces, causing the points or edges to penetrate into the softer washer material. Over a period of time, the washer 42 may wear. If and when it does, it can simply be replaced by another washer of like or equivalent construction.

Referring to FIG. 6, the threads 70 on the bolt 18 and the threads 72 within the opening 38 are preferably relatively fine machine threads. This allows them to provide a tight connection that will not work itself loose. The presence of the washer 42 also helps preventing the threads from working themselves loose.

As shown by FIG. 6, the bolt head 28 may include an Allen wrench receiving socket 74, or the like. The outer surface of the bolt head that surrounds the socket 74 may be made smooth so as to match a surrounding smooth surface 78 on the hosel 14. The countersinking of the bolt head 28, and the somewhat rounded smooth construction of the surfaces 76, 78 provides an attractive look to the heel end of the club head/hosel assembly.

The aforementioned U.S. Pat. Nos. 2,027,452; 2,214,079; 2,091,794; 2,962,286; 3,601,399; 5,133,553, and 5,928,087 provide adjacent surfaces on the hosel region of the shaft and the heel region of the club head with marks:and indicia for identifying a particular setting of the club head relative to the club shaft. According to the present invention, a rear heel portion of the club head 16 is provided with position marks and the adjacent hosel region is provided with a reference mark 82. A difference is that in the club of the present invention the position marks 80 can be exact loft angles corresponding, to the several clubs of a set, or a sub-set (the wedges), and are not limited by the settings that are possible when interengaging serrations of teeth are used between the club head and the club shaft.

The washer 42 may be of composite construction. It may be made of two thin sheets of metal on opposite sides of a somewhat resilient plastic core. An advantage of this construction is that the tightening of the bolt 28 will compress the composite washer. This stores spring energy in the composite washer that will exert itself on the mating threads 70, 72 and act similar to a lock washer.

Figure 11:
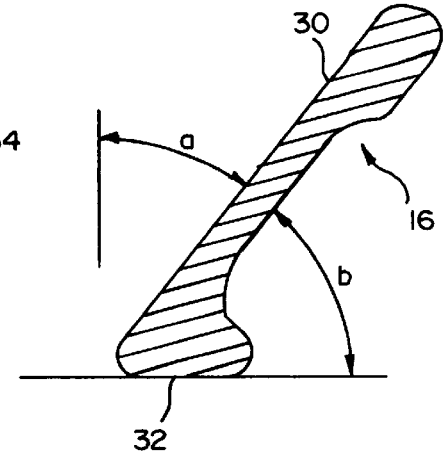
FIG. 11 is a sectional view taken substantially along line 11—11 of FIG. 2.

FIG. 11 is a sectional view of a pitching wedge that has been provided with a lower surface 32 that is substantially tangent to the ground when the face 30 of the wedge is set at a maximum loft angle. This construction of the lower edge 32 prevents the club from digging into the ground below where the face 30 meets the lower edge 32. When the loft angle a is made smaller, the rear portion of the surface 32 will move upwardly at an angle to the ground.

It may also be desirable to provide the club with a head that simulates a wooden club head. At the present time, the so-called "wood" heads are made form metal. They are sometimes referred to as "a metal wood" head. The wood head can be attached by the structure shown by FIG. 2. It can have a roughened surface 40 that contacts one side surface of a washer 42. The opposite side surface of the washer 32 may be in contact with a roughened surface-like surface 24, provided on the lower end eye portion of the hosel 14.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. In a golf club having a club head that is adjustably connected to a hosel for changing the loft angle of the club, an improvement comprising:

said hosel having a lower end portion that includes a transverse bolt receiving opening having first and second ends, and an annular, substantially flat, metal, first end surface at the first end of said opening;

said club head having a heel, an internally threaded bolt receiving opening in said heel extending into said club head substantially lengthwise of the club head, and an annular, substantially flat, metal, heel surface surrounding the bolt receiving opening in said club head;

a flat washer positionable axially between the metal first end surface on said hosel and the metal heel surface on the club head, said washer having a center opening and opposite sides;

a bolt having a head, a threaded shank extending from the head, and a bolt axis, said shank being fittable through the bolt receiving opening in the hosel, and through the center opening in the washer, and being threadable into the bolt receiving opening in the club head, wherein the club head can be rotated about the bolt axis to provide a desired loft angle and then the bolt can be tightened to connect the club head to the hosel at the selected loft angle, wherein the washer is made from a material that is softer than the metal, first end surface on the hosel and is softer than the metal, heel surface on the club head, and wherein the metal, first end surface on the hosel and the metal, heel surface on the club head are rough surfaces having grains that penetrate into the opposite sides of the washer when the bolt is tightened, for holding the club head against rotation relative to the hosel.

2. The golf club improvement of claim 1, wherein the metal first end surface on the hosel and the metal heel surface on the club head are sandblasted to form the grains and make them rough surfaces.

3. The golf club improvement of claim 2, wherein the washer material is at least predominately aluminum.

4. The golf club improvement of claim. 1, wherein the washer material is at least predominately aluminum.

5. The golf club improvement of claim 1, wherein the hosel includes a countersink at the second end of the bolt receiving opening sized to receive the bolt head and the bolt head is in the countersink when it is tightened.

6. The golf club improvement of claim 5, wherein the metal first end surface on the hosel and the metal heel surface on the club head are sandblasted to make them rough surfaces.

7. The golf club improvement of claim 6, wherein the washer material is at least predominately aluminum.

8. The golf club improvement of claim 5, wherein the washer material is at least predominately aluminum.

9. The golf club improvement of claim 1, wherein the metal first end surface on the hosel and the metal heel surface on the club head have grains in the form of small points that penetrate into the washer.

10. The golf club improvement of claim 9, wherein the washer material is at least predominately aluminum.

11. The golf club improvement of claim 1, wherein the metal first end surface of the hosel and the metal heel surface on the club head include grains in the form of lines with edges that penetrate into the washer.

12. The golf club improvement of claim 11, wherein the washer material is at least predominately aluminum.

13. The golf club improvement of claim 1, wherein the club head is substantially infinitely adjustable between maximum and minimum loft angles and the grains on the rough surfaces will hold the club head in substantially whatever position it is sent into between the limits.

14. The golf club improvement of claim 13, wherein the washer is at least predominately aluminum.

* * * * *